United States Patent [19]

Davis, Jr.

[11] 4,264,021

[45] * Apr. 28, 1981

[54] HAND HELD ELECTRIC CAULKING GUN

[76] Inventor: George B. Davis, Jr., 7512 Marbury Rd., Bethesda, Md. 20034

[ * ] Notice: The portion of the term of this patent subsequent to Oct. 16, 1996, has been disclaimed.

[21] Appl. No.: 92,959

[22] Filed: Nov. 9, 1979

Related U.S. Application Data

[63] Continuation of Ser. No. 26,654, Apr. 3, 1979, which is a continuation-in-part of Ser. No. 876,048, Mar. 8, 1978, Pat. No. 4,171,072.

[51] Int. Cl.[3] ..... B67D 5/46

[52] U.S. Cl. ..... 222/326; 222/333; 222/391

[58] Field of Search ..... 222/333, 391, 325-327; 74/125, 122, 125.5

[56] References Cited

U.S. PATENT DOCUMENTS

| | | | |
|---|---|---|---|
| 2,367,346 | 1/1945 | Good | 222/391 X |
| 2,928,574 | 3/1960 | Wagner | 222/333 X |
| 3,401,847 | 9/1968 | Downing | 222/391 X |
| 4,072,254 | 2/1978 | Cox | 222/391 |
| 4,171,072 | 10/1979 | Davis, Jr. | 222/326 |

FOREIGN PATENT DOCUMENTS

| | | | |
|---|---|---|---|
| 711670 | 9/1931 | France | 74/125 |

*Primary Examiner*—Charles A. Marmor

[57] ABSTRACT

A hand-held electric caulking gun wherein a caulking-driving piston is forced through the caulk-retaining receptacle of the gun in a manner to force caulking from the gun with considerable force and at a continuous easy-to-control flow. The gun includes a spring type clutch linkage between the motor and piston that operates to yieldably disengage the drive source from the piston should the reacting force against the caulk driving end of the piston exceed a predetermined value and a releasing device for allowing the piston to be disengaged of its drive linkage for allowing manual movement of the piston in either direction through the gun.

24 Claims, 10 Drawing Figures

FIG. 1
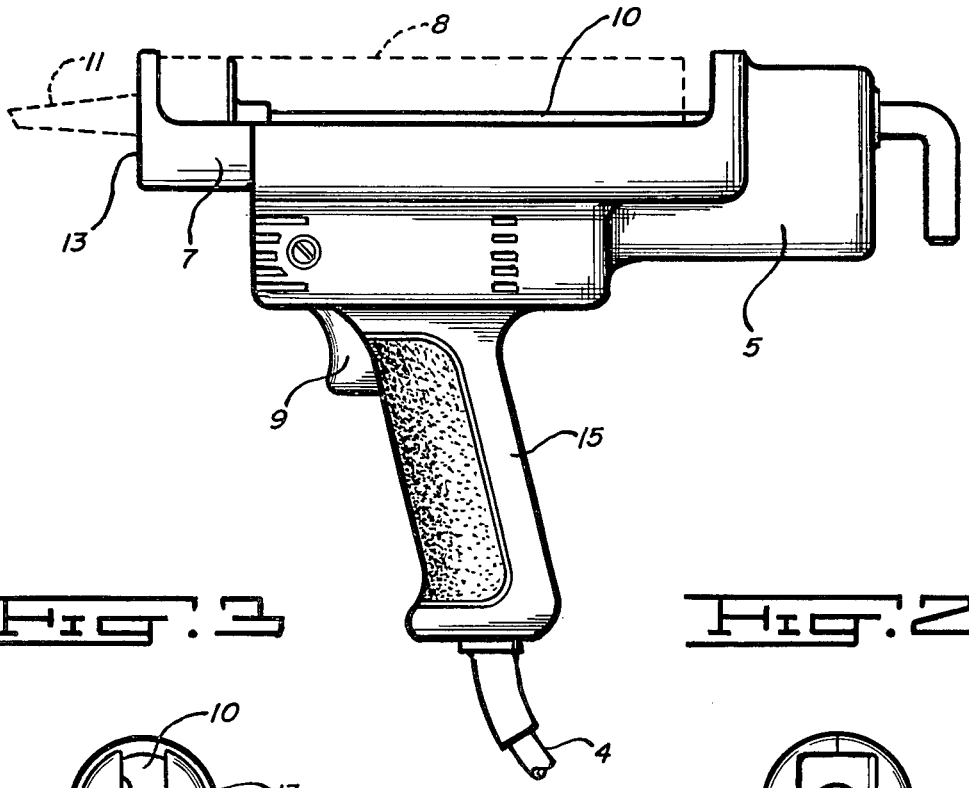
FIG. 3
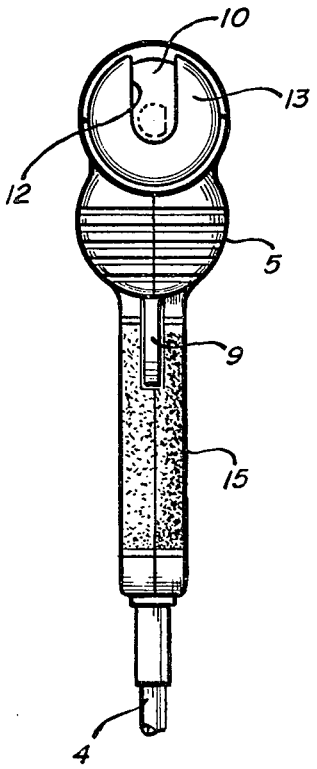
FIG. 2
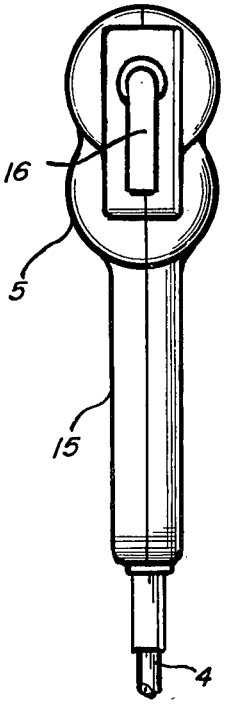
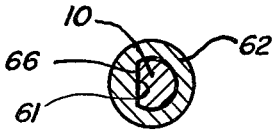
FIG. 10

Fig. 6
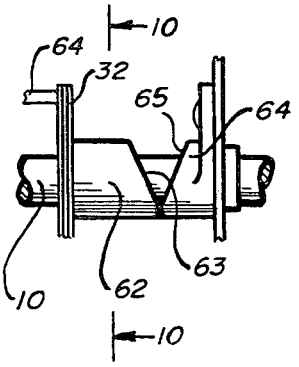
Fig. 4
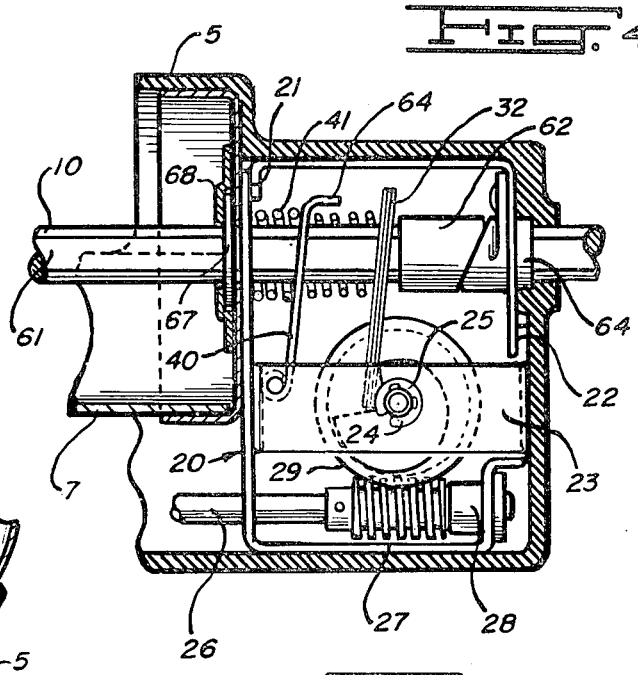
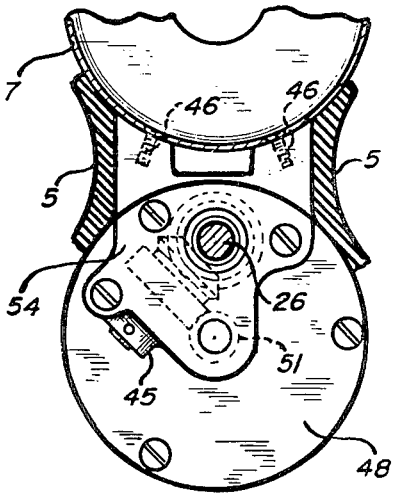
Fig. 8
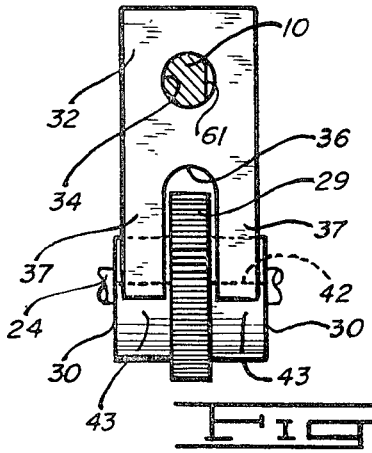
Fig. 5
Fig. 9
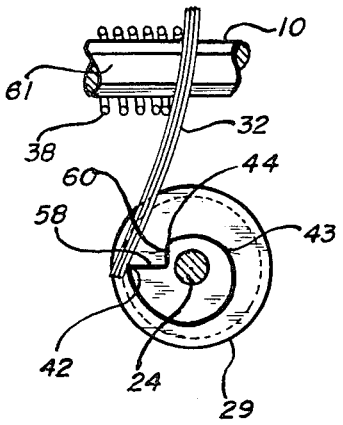
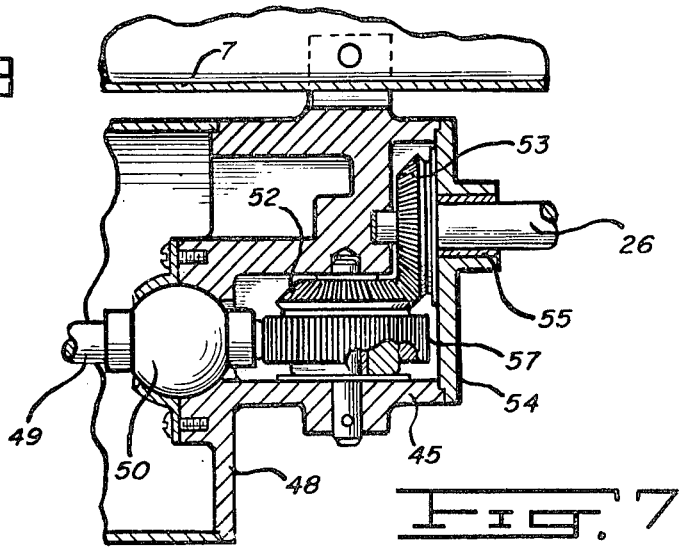
Fig. 7

HAND HELD ELECTRIC CAULKING GUN

This application is a continuation in part of now pending application Ser. No. 26,654 filed Apr. 3, 1979, which is a continuation in part of application Ser. No. 876,048, filed Mar. 8, 1978 now matured into U.S. Pat. No. 4,171,072.

Caulking guns are well known in the art and are designed primarily for dispensing caulking that comes prepackaged within a cylindrical-like container or cartridge having projecting therefrom a dispensing nozzle through which the caulking is forced during the caulking operation. These guns include a receptacle wherein is received the cartridge with means being provided for driving a piston-like member through the cartridge thusly forcing the caulking from the nozzle.

Generally the piston of such apparatus is driven by variously constructed hand operated leverage mechanisms which serve to multiply the force applied, to more easily urge the piston through the cartridge. It is well known, however, that even with the mechanical advantage offered by such force multiplying mechanisms the effort required to drive the piston is considerable and frequently beyond the gripping capability of many. Yet in many instances the very livelihood of such individuals with trades such as painters, boatmen and general home repairmen depend upon operating such caulking guns.

It is the primary object of the present invention to provide an electric hand-held type caulking gun wherein the power required to drive the piston through the gun is applied by means of an electric motor which, by the closing of an electric switch, will enable even a child to dispense caulking of the most viscous composition and at a continuous, easy-to-control flow, and in a manner unobtainable with conventional hand operated apparatus of this type.

It is a further object to provide a caulking gun of the type herein described wherein upon emptying of the caulking cartridge or upon any other form of forceful interrupted forward movement of the driven piston, a resilient spring type clutching mechanism effects an interruption of the motor drive to the piston thereby preventing damage to the housing or driving train mechanism of the gun during this overloading interval.

A further object is to provide an electrically driven caulking gun wherein the resilient action of a spring driving mechanism within the drive linkage between the motor and piston operates to yieldably respond in a clutch like manner to the reacting pressure against the piston, to apply more or less pressure to the caulking being driven from the gun as the need requires and further operates to drivably disengage the motor from the piston should the reacting pressure against the piston exceed a predetermined value.

A still further object is to provide an electric caulking gun wherein the electric drive includes a variable speed control that will allow fast or slow dispensing of the caulking from the caulking cartridge as desired.

A further object is to provide an electric caulking gun including quick disengagement of the drive linkage from the piston after emptying of the cartridge thereby allowing the piston to be freed of the drive linkage to allow the piston to be manually movable in either direction through the gun.

Another object is to provide a hand-held electric caulking gun wherein the piston driving mechanism of the gun includes a rotating cam surface and wherein the direction of rotation of this cam surface is along a plane parallel with the piston's axis.

An additional object is to provide an electric caulking gun inexpensive to manufacture, rugged and reliable in operation while being light in weight for one hand operation.

Other objects and advantages will become more apparent when referring to accompanying description and drawings wherein:

FIG. 1 is a side view in elevation of the caulking gun of the present invention.

FIG. 2 is a rear view in elevation of the gun of FIG. 1.

FIG. 3 is a front end view in elevation of the gun of FIG. 1.

FIG. 4 is a view partly in elevation and partly in section of the drive mechanism of the gun of FIG. 1.

FIG. 5 is a view in elevation of the drive plate as related to the gun piston and driven cam.

FIG. 6 is a fragmentary view partly in elevation and partly in section of the driving and driven plates as forced by the release sleeve to their piston freeing position.

FIG. 7 is a fragmentary section of the gun and showing as a cutaway a portion of the speed reducing linkage of the gun.

FIG. 8 is a rear view partly in section and partly in elevation of the arrangement of the motor and gear housing as related to the receptacle of the gun.

FIG. 9 is a view partly in section of the piston driving plates in their overriding position with respect to the high surface upon the cam.

FIG. 10 is a cross sectional view taken along section 10—10 of FIG. 6 and showing the relation of the plates respectively upon the piston and sleeve.

Referring now to the drawings and particularly to FIG. 1 thereof wherein is shown a view of the gun in elevation and as including a plastic clam-shell type housing 5 suitably secured about the mechanism of the gun as shown. Fastened within the housing is a caulk receiving receptacle 7 preferably formed of thin steel or aluminum for lightness and strength and wherein is received a caulk containing cartridge 8. When using the caulking gun, as herein shown, a cartridge is placed within the receptacle 7 whereupon, by operation of the motor within the gun by depressing trigger 9, a piston 10 is caused to be forcefully driven through the cartridge as required to force caulking from the cartridge by way of the nozzle 11. The nozzle extends from the gun through a notch 12 formed within the forward plate 13 of the receptacle.

The handle portion of the gun 15 and including the trigger 9 and power supply cord 4, is shown as positioned well forward upon the gun case and thereby to more effectively balance the gun when supporting the weight of a caulking filled cartridge within the receptacle and provides a one hand operation of the gun. The trigger 9 is preferably of the long stroke type and shall include a variable speed control for the motor. A long stroke trigger, included in such a control, will provide for a more gradual control of the motor speed and thereby a more effective control of caulking flow from the gun.

From the rear of the gun, FIG. 2, extends the piston handle 16. This handle when in an upward position, operates to release the piston from its driving linkage with the motor thereby allowing the piston to be manually moved in either direction through the gun as will hereafter be more fully described.

In FIG. 4 is shown the piston driving mechanism of the gun as enclosed within a metallic frame structure generally designated 20 and preferably formed from light gage steel and as a two section assembly secured together as at 21 and 22. The lower and high stressed portion of the frame is of heavier gage metal and includes a cross strip 23 through which transversely to the piston axis, extends the gear shaft 24 suitably secured as by clip 25. Through the lower portion of the frame extends the drive shaft 26 that includes a worm gear 27. While here the worm 27 is shown as a separate component mounted upon and secured to the shaft, it is understood that this worm gear may be formed directly into the shaft's surface if so desired; however, in either instance the material of the worm should be of hardened and polished steel. An oil impregnated bearing 28 within the frame operates to support the outer or free end of the shaft 26 as the shaft is rotated to drive gear 29.

Gear 29 includes a pair of cam surfaces 30, as shown to advantage in FIG. 5. These cam surfaces rotate in a plane common with the piston axis and may be formed as an integral portion of the gear or stamped and drawn from sheet stock and secured by rivits to the respective sides of the gear. Preferably these cam surfaces should be hardened.

The piston 10 is driven through the receptacle 7 of the gun toward its caulk driving position by reciprocal movement of a resilient spring driving plate 32 through which the piston extends as through hole 34. The plate further includes a notch 36 of which the legs 37 thereof extend downward to straddle gear 29. In this manner the gear 29 operates to stabilize the plate during its piston driving motion and as effected by reciprocal movement of the cam surfaces upon gear 29 as the gear is rotated. The legs of the plate are maintained in bearing contact with the cam surfaces 30 by spring 38 mounted over the piston and that further operates to return the plate to its initial or retracted and tilted position as shown in FIG. 4 upon the completion of each cam driving stroke. Forward movement of plate, when in its tilted position and as driven by the cam, operates to drive the piston forward through the gun and consequently caulking from the cartridge nozzle 11.

Hingedly secured to the frame 20 in a holding plate 40. The piston extends through a hole in this plate in a similar manner to plate 32. The holding plate 40 is yieldably held in a tilted and piston gripping position by spring 41 that here is much stronger than spring 38. In operation, forward motion of the piston, whether driven manually or by the mechanism of the gun, carries forward the holding plate as required to momentarily disengage it from the piston shaft and thereby free the piston for forward movement through the gun. Upon a stopping of the piston, the spring 41 instantly operates to urge the plate 40 backward to the tilted and piston locking position to effectively hold the piston in its newly advanced position. This reciprocal operation of the piston driving and holding plates effects a gradual and forceful advance of the piston through the gun and as driven by the reciprocal action of the high and low surfaces upon the cam's surface during rotation of gear 29.

The drive plate 32 is shown as comprised of plurality of juxtaposed spring strips that together operate to give the necessary stiffness to the plate to drive the piston through the gun at the pressure desired. While it is understood that a single thicker and stiffer plate will likewise suffice, it has been found that unless such a plate is of a sufficient length as to withstand the necessary flexing required during its clutching operation, as will later be described, the material of a thicker short plate will soon fatigue to take on a permanent set or break when caused to sufficiently flex as to override the high surface upon the cam and that occurs should piston movement be forcefully stopped during motor operation. The multiple strip plate, as herein shown, can be constructed of the necessary number of strips required to deliver the same during stroke to the piston while being more flexible and of a shorter length. A short plate of this nature will permit the arrangement of a more compact piston driving structure within the frame 20 than can be effectively accomplished with a single strip plate. While in FIG. 9 the strips of the plate are shown as operating independently to drive the piston. If desired, the plates may be secured together above the notch 36 for ease of handling and assembly.

As apparent, the piston 10 is driven through the gun by reciprocal movement of plate 32 as caused by the counter-clockwise rotation of the progressively extending cam surfaces 43 as gear 29 is rotated. It will further be noted that the leading or beginning edge 44 of the cam surface is high or more distant from the gear axis than is the surface 60 of the cam. In operation and with a constant rotation of the cam, this high edge 44 is caused to advance more rapidly against the drive plate 32 than is the rate of advance of the following cam surface 43. This momentary and rapid advance of this high edge against the drive plate operates to quickly take up the slack in the drive linkage between the drive mechanism and piston during the momentary interval the piston is at rest and that occurs as the drive plate and cam rapidly moves to their reset position following each cam driving stroke. This rapid reset of the drive plate and cam takes place before the built up pressure within the cartridge drops to a zero state; therefore, caulking is caused to flow from the discharge nozzle of the cartridge at a comparitively constant rate even during the reset operation.

In operation the notch surface 58 of the cam is caused to move slightly below the gear axis before clearing the end of the drive plate 32 whereby the drive plate is caused to move more gradually along the now inclined surface 58 to its reset position against the surface 60 of the cam. This arrangement eliminates the snap or click that would otherwise occur should the plate 32 be allowed to snap to reset position.

From the worm 27 the shaft 26 extends forward and into the gear housing 45 that is secured to the receptacle of the gun as by screws 46. This housing is preferably formed as an aluminum die-casting for lightness and strength and desirably as an integral part of the motor end plate 48. The motor shaft 49 extending into the gear housing through bearing 50 and includes a worm gear surface 51 that operates, as the shaft rotates, to drive gear 57. A bevel gear 52, secured preferably as by pressing into gear 57, engages in driving relation a similar gear 53 and consequently shaft 26 to which the gear 53 is secured. Shaft 26 extends the motor drive to the caulk driving piston of the gun.

The housing 45 is shown closed by a cover plate 54 that includes the shaft bearing 55. This closed compact housing provides a necessary lubricant receptacle about the high speed gear components of the gun's drive mechanism. This worm and gear linkage between the motor and piston operates to effectively reduce the approximate motor speed of 14,000 rpm to 10 rpm at gear 29 and represents but a two stage gear reduction and a few ounces in gear weight. This arrangement provides a further advantage in that the plate driving cams are caused to rotate about an axis transverse to the piston axis thereby eliminating the side reacting thrust upon the gun's handle that is distinctly noticeable to the operator of a gun wherein the driving cam is rotating about an axis parallel with the piston axis and wherein the cam thrust is transverse to the handle.

The piston is provided with a longitudinally extending flat 61. A sleeve 62, positioned over the piston, includes a similar internal flat 66, FIG. 10, and a cam surface 63 as shown in FIG. 6. These engaging flats allow the piston to be directed axially through the sleeve but operates to cause rotation of the sleeve as the piston is rotated about its axis as by the rotation of handle 16. Rotation of the handle to an upward position operates to release the piston from both the driving plate 32 and holding plate 40 by causing the cam surface 63 upon the sleeve to cam the sleeve forward against the cam surface 65 upon the fixed member 64 to the position shown in FIG. 6. This operation drives forward both the drive plate 32 and holding plate 40 by action of the drive plate engaging the rearwardly extending flange 64 upon plate 40. These plates when so driven to the vertical position shown in FIG. 6, are now free of their gripping relation with the piston allowing the piston to be manually moved in either direction through the gun. Further, this manner of piston release serves to instantly release the piston pressure against the caulking within the cartridge to reduce caulking dribble from the cartridge nozzle.

A freely rotating washer 67 and including an internal flat corresponding to the piston flat 61, rotates within a loosely fitting retaining washer 68 and operates to scrape any caulking from the piston shaft before being carried by the shaft into the mechanism of the gun during a caulking procedure.

Because of the speed reduction required of the drive linkage between the motor and piston, a relatively small and lightly constructed motor will suffice to drive the piston through the gun with considerable force. Therefore, because of this developed force at the low speed end of the drive, the spring action of the driving plate as connecting with the driving cam surface provided within the drive linkage between the motor and piston a yieldable clutch type mechanism that is operable to disengage drivably the motor from the piston should overloading or stopping of the piston occur during operation of the motor. Such a stopping of the piston could be caused by the piston reaching its most forwardly position within the cartridge or by the operator attempting to force old and set-up caulking from the gun. Such forceful stopping of the piston during motor operation could result in a binding up or damage to the drive mechanism of the gun or rupture of the gun case. What must further be considered with such power operated guns, is the natural flow rate of the caulking being dispensed. Caulking at widely differing viscosities will flow at widely different rates from the same size discharge orifice in the nozzle under the same pressure conditions. Any attempt to forcefully accelerate this normal flow rate will result in rupture of the cartridge case. Here the plate and cam operates to disengage the drive source should the maximum force against the piston exceed a predetermined value and as herein set below the rupture point of the cartridge case. In the present gun the slipping point of the clutch is preset to disengage the drive between the motor and piston when the piston pressure exceeds say 100 psig. This operating pressure produced by the gun exceeds by at least three times the force generally applied to caulking dispensed from hand operated guns and yet is well within the rupture point of the cartridge case.

Describing briefly the operation of the gun. To free the piston for manual operation; the piston handle 16 is rotated to an upward position and as required to disengage the piston from its driving linkage with the motor. The now free piston is manually retracted by the handle sufficiently as to place a caulking cartridge within the receptacle portion 7 of the gun. The piston is then manually directed against the base of the cartridge and the piston handle rotated to a downward position. This readies the gun for operation. A subsequent depressing of trigger 9 effects, by way of the drive linkage with the motor, rotation of the driving cam 43 which in turn and by way of the piston driving plate 32 effects forceful movement of the piston through the gun and therefore driving caulking from the nozzle 11.

The rate at which the piston is driven through the gun is determined primarily by the degree of movement as applied manually to the motor speed controlling trigger 9. The spring piston driving plate within the drive train between the motor and piston further operations, on the high side, to control piston travel and as determined by the flow rate of the particular caulking being dispensed. The resilience of the plate 32 will operate to prevent piston movement through the gun at a faster rate than the caulking can flow from the cartridge nozzle regardless of motor speed and as controlled by the trigger. It has been found that caulking flow from the gun can be effectively directed and controlled when dispensed at a rate represented by a piston travel of 1 to 2 inches per minute depending upon the size of the discharge orifice in the nozzle and viscosity of the caulking.

While herein is shown the drive plate as sufficiently resilient to override the high surface 42 upon the cam during its clutching action as by the forceful stopping of the piston during motor operation, it is understood that by mounting the gear 29 upon a movable bracket that is spring biased forward, will allow rearward movement of this gear when a clutching action in the drive linkage is required and thereby to permit a shorter and less flexible piston driving plate being used in order to further compact the drive mechanism of the gun. Here this structure will permit the cams and gear to reciprocate backward to absorb the driving stroke of the cam as it overrides the plate's surface.

While it may be generally accepted that an A.C. motor will be used to power the gun, it is understood that a permanent magnet D.C. motor will likewise suffice. Such a motor will deliver the same speed and torque while being of considerably less weight and smaller in size. Because the variable speed control within the trigger is a form of duty-cycle device and operable only with A.C. current, the use of a D.C. motor for the gun will require that a small rectifier assembly be connected between the speed control and motor. Since the motor and gear train represents the major weighty components of the gun and wherein it is desired to limit the gun's total weight to three pounds or less for one hand operation, the weight of the motor and gears are of primary importance.

In the mechanism shown, all piston driving parts shall be formed preferably from hardened steel, otherwise where practical, all parts throughout the gun shall be of the lightest material suitable for the purpose in order to produce a light rugged gun structure.

It is to be understood that throughout the gun where needed, all bearing surfaces shall be of the oil impregnated type or better and suitable thrust bearing surfaces shall be provided where necessary throughout the gun in accordance with good manufacturing practice.

It is further understood that certain modification and arrangements of the components shown may be provided without departing from the inventive concept as disclosed.

What I therefore claim and desire to cover by letters patent is:

1. A hand held electric caulking gun including in combination, a receptacle for receiving therein a caulking containing cartridge having a caulk dispensing nozzle thereon, a piston having its longitudinal axis substantially common with said receptacle and movable when driven forward through said cartridge to force the caulking therein from said nozzle, a gear rotatable about an axis substantially transverse to said piston axis, a cam surface forming a part of said gear, an electric motor, a speed reducing drive train connecting said motor with said gear whereby operation of said motor causes rotation of said gear and rotary movement of said cam surface, a spring piston driving plate disposed about said piston and movable by rotary movement of said cam surface to engage in gripping relation the surface of said piston to drive the piston through said cartridge to force caulking therein from said nozzle, said spring piston driving plate being sufficiently flexible as to yieldably absorb the total rotary movement of said cam surface in a manner to interrupt the driving movement between said cam surface and piston should forward movement of the piston be forcefully interrupted during operation of said motor.

2. A caulking gun as called for in claim 1 wherein holding means movably operate to hold said piston in its plate driven position.

3. A caulking gun as called for in claim 2 wherein manually movable release means operate to release said piston from both the driving plate and holding means to allow manual movement of the piston in either direction through the gun.

4. A caulking gun as called for in claim 1 wherein said spring piston gripping plate is comprised of a plurality of spring strips.

5. A caulking gun as called for in claim 4 wherein said spring strips comprising said plate are at least in part commonly secured together.

6. A caulking gun as called for in claim 1 including means movable to drivably disengage said piston driving plate from said piston upon a predetermined further rotary movement of said cam surface.

7. A caulking gun as called for in claim 1 wherein said spring piston driving plate includes a notch within which the said gear rotates.

8. A caulking gun as called for in claim 1 wherein the speed of said electric motor can be selectively varied.

9. A hand-held electric caulking gun including in combination, a receptacle for receiving therein a caulk containing cartridge having a caulk dispensing nozzle thereon, a piston including a longitudinal axis substantially common with said receptacle and movable when driven forward through said cartridge to force the caulking therein from said nozzle, a cam surface rotatable about an axis substantially transverse to said piston axis, a gear surface forming a part of said cam surface, an electric motor, a speed reducing drive train connecting said motor with said gear surface whereby operation of said motor causes motion of said gear surface and rotary movement of said cam surface, a spring piston driving plate disposed about said piston and movable by rotary movement of said cam surface to engage in gripping relation the surface of said piston to drive said piston through said cartridge and caulking therein from said nozzle, said spring piston driving plate being sufficiently flexible as to yieldably absorb the total rotary movement of said cam surface should forward movement of the piston be forcefully interrupted during operation of said motor.

10. A caulking gun as called for in claim 9 wherein holding means movably operate to hold said piston in its plate driven position.

11. A caulking gun as called for in claim 10 wherein manually movable release means operate to release said piston from both the driving plate and holding means to allow manual movement of the piston in either direction through the gun.

12. A caulking gun is called for in claim 9 wherein said piston gripping plate is comprised of a plurality of spring strips.

13. A caulking gun as called for in claim 12 wherein said spring strips comprising said piston gripping plate are at least in part commonly secured together.

14. A caulking gun as called for in claim 9 wherein means movably operate to disengage said piston gripping plate from its gripping relation with the piston upon a predetermined further rotation of said cam surface.

15. A caulking gun as called for in claim 9 wherein said gear surface forms a part of gear said speed reducing drive train and rotatable about an axis common with said cam surface.

16. A caulking gun as called for in claim 15 wherein said piston driving plate includes a notch within which said gear surface rotates.

17. A caulking gun as called for in claim 9 wherein the speed of said electric motor is selectively variable.

18. A hand-held electric caulking gun including in combination, a receptacle for receiving therein a caulk containing cartridge having a caulk dispensing nozzle thereon, a piston including a longitudinal axis substantially common with said receptacle and movable when driven forwardly through said cartridge to force the caulking therein from said nozzle, a cam surface rotatable about an axis substantially transverse to said piston axis, an electric motor, a speed reducing drive train connecting said motor with said cam surface and operative when driven by said motor to cause rotary movement of said cam surface about its axis, a spring piston driving plate disposed about said piston and movable by rotary movement of said cam surface to engage in gripping relation the surface of said piston to drive said piston forward through the cartridge and caulking therein from said nozzle, said spring piston driving plate being sufficiently flexible as to yieldably allow rotary movement of said cam surface without causing movement of said piston should forward movement of the piston be forcefully interrupted during operation of said motor.

19. A caulking gun as called for in claim 18 wherein holding means movably operate to hold said piston in its plate driven position.

20. A caulking gun as called for in claim 19 wherein manually movable release means operate to release said piston from both the driving plate and holding means to allow manual movement of the piston in either direction through the gun.

21. A caulking gun as called for in claim 18 wherein means movably operate to drivably disengage said piston driving plate from its gripping relation with the piston upon a predetermined further rotation of said cam surface.

22. A caulking gun as called for in claim 18 wherein said cam surface forms a part of a worm driven gear in said speed reducing drive train and rotatable about an axis common with said cam surface.

23. A caulking gun as called for in claim 22 wherein said piston driving plate includes a notch within which the said worm driven gear rotates.

24. A caulking gun as called for in claim 18 wherein the speed of said electric motor is selectively variable.

* * * * *